United States Patent [19]

Sharkey

[11] 4,127,066

[45] Nov. 28, 1978

[54] ADJUSTABLE COMPRESSION ROLLER APPARATUS

[76] Inventor: Melvin Sharkey, 1614 Hereford Rd., Hewlett, L. I., N.Y. 11557

[21] Appl. No.: 795,683

[22] Filed: May 11, 1977

[51] Int. Cl.[2] ..... B41F 7/00

[52] U.S. Cl. ..... 101/132; 29/116 AD; 100/162 B; 100/168; 100/169

[58] Field of Search ..... 101/130, 131, 132, 132.5; 29/113 AD, 116 R, 116 AD; 100/162 B, 169, 168, 163 A

[56] References Cited

U.S. PATENT DOCUMENTS

| | | | |
|---|---|---|---|
| 864,660 | 8/1907 | Love | 100/162 B |
| 2,851,869 | 9/1958 | Quoos | 100/162 B X |
| 2,903,963 | 9/1959 | Harris et al. | 101/132.5 |
| 3,306,195 | 2/1967 | Curtri | 101/132.5 |
| 3,322,065 | 5/1967 | Procter et al. | 101/132.5 |
| 3,648,599 | 3/1972 | Rinberger | 100/169 |
| 3,736,869 | 6/1973 | Motter et al. | 29/116 AD X |

*Primary Examiner*—Ronald E. Suter
*Attorney, Agent, or Firm*—Thomas L. Tully

[57] ABSTRACT

A pressure-roller apparatus comprising two compression rollers providing a pressure nip therebetween for the introduction of sheets or other thin members to be compressed and fed. The degree of pressure in the nip is variable by means of one or more adjustment roller assemblies comprising adjustment rollers which are substantially shorter in length than said compression rollers and which engage one of said compression rollers at one or more points intermediate its ends to provide an intermediate and balanced pressure adjustment which avoids bowing of said compression roller.

6 Claims, 3 Drawing Figures

ADJUSTABLE COMPRESSION ROLLER APPARATUS

A variety of pressure devices are known which include compression rollers providing a pressure nip therebetween for purposes of feeding, compressing, printing, embossing, laminating and otherwise treating sheets or other thin materials in said nip. In many such machines it is desirable to be able to increase the pressure in the nip and therefore pressure adjustment means such as screws are provided at the journals supporting one of the compression rollers in slide bearings, permit depression of the slide bearings and consequent depression of the supported compression roller more tightly against the companion compression roller with which it forms the nip. British Patent No. 853,899 is representative of such an adjustable pressure roller assembly as used in connection with a pressure duplicating apparatus.

Such prior known adjustable compression roller assemblies are unsatisfactory for a number of reasons. The greatest disadvantage is the fact that compression rollers, particularly those having a length which is substantially greater than their diameter, bow or warp as the downward pressure is increased on the slide bearings at each end of the roller. Thus the pressure in the nip is uneven, being greater at the ends of the compression roller adjacent the slide bearings and decreasing towards the center of the compression roller where maximum bowing or bending of the roller occurs. Thus the pressure of the nip in the center of the rollers may be insufficient to accomplish the desired results while the pressure of the nip at the ends of the rollers may be so great as to cause undesirable results.

In addition, such known adjustable compression roller devices encounter excessive bearing wear, due to the bowing of the pressure roller, do not compensate for irregularities in the roundness or diameter of the pressure roller and require uniform similar adjustment at both ends of the pressure roller.

It is the principal object of the present invention to provide a pressure roller apparatus comprising compression rollers having a pressure nip therebetween, the pressure at said nip being adjustable by an adjustment means which engages the surface of one of said compression rollers, rather than the shaft or bearings thereof, to permit adjustment without bowing.

It is another object of one embodiment of the present invention to provide an adjustable pressure roller apparatus in which a single adjustment can be made to provide a uniform adjustment of the pressure across the entire nip.

It is still another object of another embodiment of the present invention to provide an adjustable pressure roller apparatus having a pressure-adjustment means which compensates for irregularities in the roundness and diameter of the compression roller which it contacts.

These and other objects and advantages of the present invention will be apparent to those skilled in the art in the light of the present disclosure including the drawing, in which.

Figure 1:
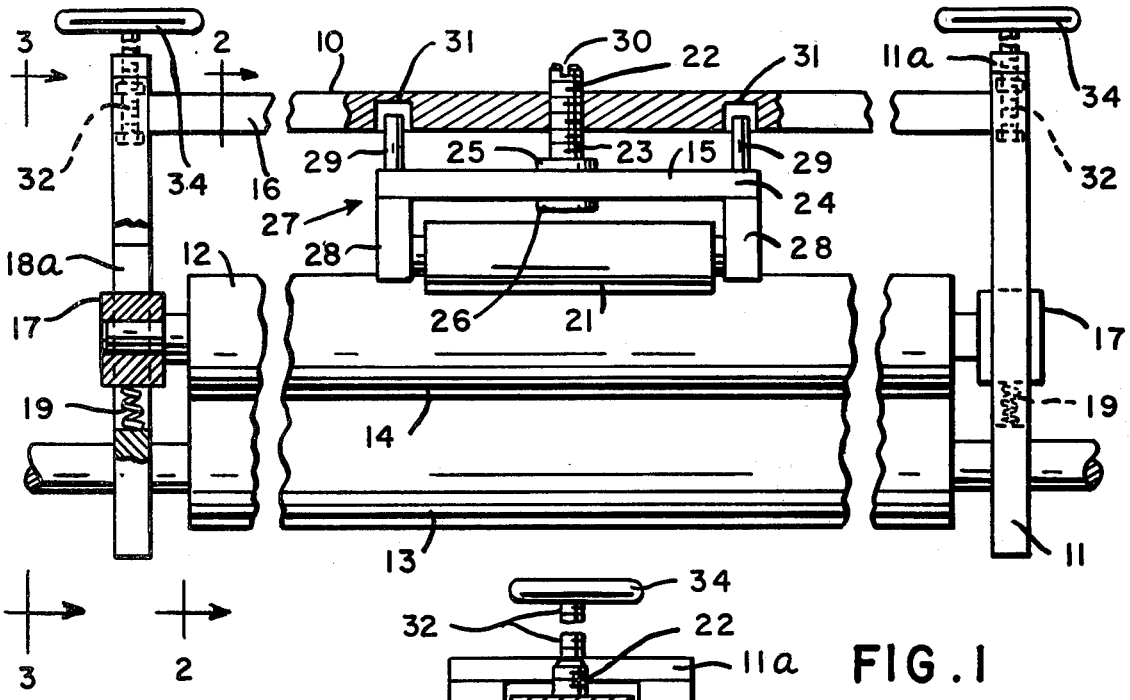
FIG. 1 is a front view, partially in section, illustrating an apparatus according to the present invention.

The novel pressure roller apparatus of the present invention comprises compression rollers which provide therebetween a pressure nip, one of said compression rollers being in surface engagement with at least one adjustable pressure roller assembly comprising at least one pressure roller which preferably is substantially shorter in length than said compression roller, engages said compression roller at one or more points intermediate its ends to provide an intermediate balanced pressure adjustment means for varying the degree of pressure exerted by said engaged compression roller against said other compression roller and consequently the degree of pressure in said nip.

Referring to the drawing, the pressure roller apparatus 10 thereof comprises a frame 11, compression rollers 12 and 13 supported by said frame and providing a pressure nip 14 therebetween, and an adjustable pressure roller assembly 15 attached to a support crossbar 16 of frame 11 and contacting the surface of the compression roller 12 opposite the nip 14.

Figure 3:
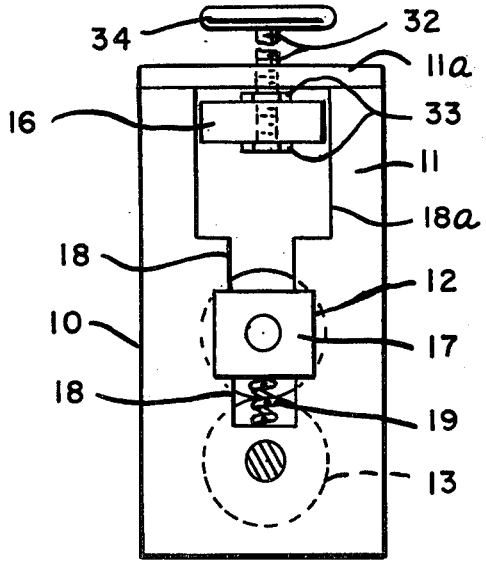

In the embodiment as illustrated, compression roller 13 is a power-driven roller which is rotatably-connected to the frame 11 and is adapted to be driven by a motor, not shown, while compression roller 12 is slidably attached to frame 11 by means of slide bearings 17 which are adapted for vertical movement in frame slots 18 towards and away from the power-driven compression roller 13, as shown by FIGS. 1 and 3. Springs 19 are confined within frame slots 18 below the slide bearings 17 to provide a lower support for the slide bearings 17, if desired.

Figure 2:
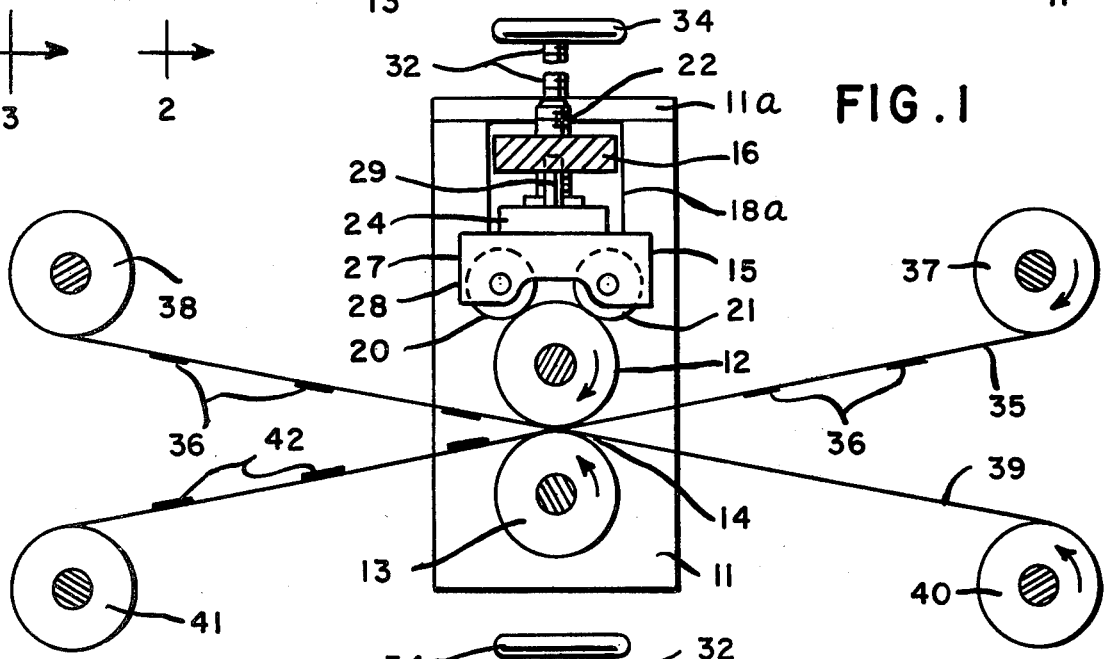
FIG. 2 is a view of the apparatus of FIG. 1 taken along the line 2—

The pressure roller assembly 15 illustrated by FIGS. 1 and 2 represents a preferred embodiment in that it is a single, centered assembly having two spaced pressure rollers 20 and 21, each of which is adapted to engage spaced areas of the surface of the top compression roller 12, and the assembly 15 is adjustably attached to the crossbar 16 by a single adjustment means 22 providing a single connection around which the assembly can pivot slightly and align itself with the surface of compression roller 12 during operation in order to compensate for slight irregularities in the roundness or levelness of the upper compression roller 12 and of pressure rollers 20 and 21. This insures uniform pressure between each of pressure rollers 20 and 21 and the top compression roller 12 and thus uniform pressure adjustment. Adjustment means 22 comprises a threaded bolt 23 which passed through an oversize opening in roller crossbar 24 and which is provided with flanges 25 and 26 which rotatably attach bolt 23 to crossbar 24.

Referring to assembly 15, the pressure rollers 20 and 21 are mounted in a housing 27 having side bearing walls 28 to which rollers 20 and 21 are rotatably attached and a top crossbar 24 to which the adjustment bolt 22 is rotatably attached in centered position and which carries alignment pins 29. The portion of the adjustment bolt 22, above the crossbar 24, is threaded and the bolt 22 threadably engages the support crossbar 16 of frame 11, means 30 being provided at the tip of the bolt 22, such as a slot or a hexagonal recess, to enable the bolt 22 to be screwed into or out of crossbar 16 to cause the pressure roller assembly 15 to move away from or towards the crossbar 16 and either increase or decrease the pressure in nip 14, as desired. The retainer pins 29 project into oversize openings or slots 31 in the underside of the support crossbar 16 to restrain the assembly 15 from rotating during adjustment of bolt 22. If desired springs may be provided in openings or slots 31 to engage the ends of the pins 29 and stabilize the assembly 15 in centered position.

As is clear from the drawing, a single adjustment, i.e., the turning of adjustment bolt 22, causes the pressure roller assembly 15 to increase or reduce the pressure exerted between the top compression roller 12 and the power-driven compression roller 13 as the pressure rollers 20 and 21 engage the surface of compression roller 12 and cause slide bearings 17 either to travel downward in slots 18 to further compress springs 19 or to travel upward in slots 18 as the compression of springs 19 is relaxed, depending upon the direction in which the adjustment bolt 22 is screwed.

While the use of a single roller assembly 15 is preferred for ease of adjustment, it should be understood that any number of such assemblies, such as two, three or even more, may be used in cases where the length and/or flexibility of the compression roller being adjusted necessitates the use of several such assemblies. Also, while the assembly 15 preferably includes at least two pressure rollers such as 20 and 21 which engage the compression roller 12 at opposite sides of its apex from a direction diametrically opposite the nip to provide uniform self-centering engagement therewith, it is possible to use any number of pressure rollers in the assembly 15, including a single centered roller where the assembly 15 is restrained against movement out of alignment with the top compression roller 12.

Also, while it is preferred that the top compression roller 12 is mounted for sliding movement towards and away from the bottom compression roller 13, such as by means of slide bearings 17 as illustrated, it should be understood that the top compression roller 12 may be a flexible roller which is attached in fixed rotating position on the frame and the assembly 15 may be used to flex the top compression roller down against the bottom compression roller to increase the pressure in the nip. Such alternative embodiments are useful depending upon the criticality of a uniform pressure across the entire nip, the length, diameter and flexibility of the top compression roller and the speed of operation of the apparatus.

According to a preferred embodiment, as illustrated, the crossbar 16 is adjustably supported by side frame bars 11*a* within enlarged frame slots 18*a* by means of end adjustment bolts 32 which are rotatably-attached to the crossbar 16 by means of free bearings 33 and which threadably engage the side frame bars 11*a*, as illustrated most clearly by FIG. 3 of the drawing. Thus the adjustment bolts 32 at each side of the frame 11 rotatably-engage the crossbar 16 by means of free bearings 33, threadably engage the side frame bars 11*a* and are provided with turning means which enable the bolts 32 to be turned into or out of the side frame bars 11*a* to increase or decrease the pressure exerted by the pressure roller assembly 15 against roller 12, such as turning wheels 34 as illustrated. Such end adjustment bolts are particularly useful in the case of compression rollers which are long and/or of relatively small diameter whereby the top roller 12 may tend to bow under the pressure of a single floating roller assembly 15 unless pressures are also applied along the length of the top roller 12 by the use of additional floating roller assemblies attached in spaced relationship to crossbar 16.

A preferred use of the adjustable pressure roller apparatus of the present invention is as a pressure duplicating apparatus for causing or assisting the pressure-transfer of imaging material from an imaged master sheet or web to a succession of copy sheets or webs to form a number of duplicate copies of the master. As illustrated by FIG. 2 a master sheet or web 35 carrying images 36 containing pressure-transferable imaging material such as colored ink is expended from supply roll 37, through nip 14 and onto motor-driven take-up roll 38 while a companion copy sheet or web 39 is expended from its supply roll 40, through nip 14 into pressure contact with the imaged surface of master web 35, and onto motor-driven take-up roll 41. The webs are supported for engagement in the nip 14 and the pressure in nip 14 causes a portion of the ink in the master images 36 to transfer to the copy sheet to form corresponding duplicate images 42 on the copy sheet as the webs are moved through the nip, as illustrated.

The duplicating process may be repeated by passing the same master sheet or web through the apparatus with a succession of copy sheets or webs to produce a relatively large number of duplicate copies. However as the amount of ink present in the master images gradually becomes depleted the intensity of the duplicate images formed on the copy sheet will gradually lessen unless the pressure in the nip is increased from time to time in order to cause the transfer of a relatively uniform amount of ink from the master images each time.

If desired, either or both of the compression rollers 12 and 13 may be provided with a thin slightly-compressible outer layer or cover or with raised and/or recessed areas having a functional purpose such as printing, embossing, laminating, etc. Also either or both of the compression rollers 12 and 13 may be provided with internal heating means where the function of the apparatus requires heating in the nip, such as in the case of heat-transfer, laminating, etc.

It should be understood that the pressure adjustment wheels 34 can be connected to each other, such as by means of a chain drive, so that a single adjustment of either wheel will be imparted to the other wheel simultaneously and an equal, balanced adjustment of crossbar 16 and the roller assembly or assemblies supported thereby will result.

Also, any suitable pressure adjustment means may be used instead of wheels 34, such as pneumatic means including pistons which are movable by means of air pressure and which are connected to crossbar 16 to adjust the position thereof relative to side frame bars 11*a*.

Variations and modifications may be made within the scope of the claims and portions of the improvements may be used without others.

I claim:

1. In a pressure roller apparatus comprising a frame, an elongate compression roller each end of which is rotatably supported by side members of said frame and the surface of which is in surface contact with another element to provide a pressure nip at the area of contact with said other element, and at least one pressure roller assembly comprising a housing rotatably supporting at least one pressure roller which contacts the surface of said compression roller opposite the surface in said pressure nip and which is adjustable in a direction towards and away from the apex of said compression roller to increase or decrease the pressure between said pressure roller and said compression roller and, consequently, the pressure in said nip, the improvement comprising a crossbar each end of which is adjustably attached to the side members of said frame for movement towards and away from the apex of said compression roller, each said pressure roller assembly being adjustably attached to said crossbar by a single adjustment means comprising a bolt which is rotatably-connected to the housing of said assembly at a centerpoint thereof and threadably engages said crossbar, rotation of said bolt causing said assembly to move towards or away from said crossbar to effect adjustment of the degree of pressure exerted by said pressure roller against said compression roller, said bolt permitting said assembly to pivot thereabout whereby the surface of said pressure roller can retain uniform pressure contact with the surface of said compression roller during operation regardless of irregularities in the roundness or levelness of either said pressure roller or said compression roller, said pressure also being variable by adjusting the position of said crossbar relative to said side members without making an adjustment in the position of each said pressure roller assembly relative to said crossbar.

2. A pressure roller apparatus according to claim 1 in which said other element is a second compression roller.

3. A pressure roller apparatus according to claim 1 in which each end of said compression roller is slidably attached to the side members of said frame for movement towards and away from said other element.

4. A pressure roller apparatus according to claim 1 in which said housing also contains at least one alignment pin and said crossbar contains a retainer means which receives said pin to restrict the rotation of said assembly about said adjustment means.

5. A pressure roller apparatus according to claim 1 in which each said pressure roller assembly comprises at least two spaced pressure rollers which engage the surface of said compression roller on opposite sides of the apex of said compression roller which is diametrically-opposite said pressure nip to confine said compression roller therebetween.

6. A pressure roller apparatus according to claim 1 comprising a pressure duplicating apparatus including means for supporting an imaged master sheet web and a copy sheet web for engagement with each other in said pressure nip and means for doving said webs through said nip to cause pfrtions of the images present on said master sheet web to transfer to said copy sheet web to produce a copy of said imaged master sheet web on said copy sheet web.

* * * * *

UNITED STATES PATENT AND TRADEMARK OFFICE

CERTIFICATE OF CORRECTION

PATENT NO. : 4,127,066

DATED : November 28, 1978

INVENTOR(S) : MELVIN SHARKEY

It is certified that error appears in the above-identified patent and that said Letters Patent are hereby corrected as shown below:

Column 1, line 66, should read --along the line 2-2 thereof; and--; insert between lines 66 to 67 the following --FIG. 3 is a view of the apparatus of FIG. 1 taken along the line 3-3 thereof--; column 6, line 19, "doving" should be --moving--; column 6, line 20, "pfrtions" should be --portions--.

Signed and Sealed this

*Twenty-sixth* Day of *February 1980*

[SEAL]

*Attest:*

SIDNEY A. DIAMOND

*Attesting Officer*

*Commissioner of Patents and Trademarks*